US009593657B2

(12) United States Patent
Kusakabe et al.

(10) Patent No.: US 9,593,657 B2
(45) Date of Patent: Mar. 14, 2017

(54) DRIVE UNIT OF FUEL INJECTION DEVICE

(75) Inventors: Ryo Kusakabe, Hitachinaka (JP); Motoyuki Abe, Mito (JP); Hideharu Ehara, Yokohama (JP); Tohru Ishikawa, Kitaibaraki (JP); Takuya Mayuzumi, Hitachinaka (JP); Kenji Hiraku, Kasumigaura (JP)

(73) Assignee: Hitachi Automotive Systems, Ltd., Hitachinaka-shi, Ibaraki (JP)

( * ) Notice: Subject to any disclaimer, the term of this patent is extended or adjusted under 35 U.S.C. 154(b) by 467 days.

(21) Appl. No.: 13/817,069

(22) PCT Filed: Aug. 8, 2011

(86) PCT No.: PCT/JP2011/068054

§ 371 (c)(1),
(2), (4) Date: Feb. 14, 2013

(87) PCT Pub. No.: WO2012/029507

PCT Pub. Date: Mar. 8, 2012

(65) Prior Publication Data

US 2013/0139791 A1 Jun. 6, 2013

(30) Foreign Application Priority Data

Aug. 31, 2010 (JP) ..... 2010-193067

(51) Int. Cl.

| | |
|---|---|
| ***F02M 69/04*** | (2006.01) |
| ***F02D 41/20*** | (2006.01) |
| *F02M 51/06* | (2006.01) |

(52) U.S. Cl.

CPC ..... *F02M 69/04* (2013.01); *F02D 41/20* (2013.01); *F02D 2041/2013* (2013.01); *F02D 2041/2037* (2013.01); *F02M 51/061* (2013.01)

(58) Field of Classification Search

CPC ..... F02D 41/20; F02D 2041/2058; F02D 2041/2017; F02D 2041/2079;

(Continued)

(56) References Cited

U.S. PATENT DOCUMENTS 4,360,855 A * 11/1982 Ohba ..... 361/154
5,992,391 A * 11/1999 Yamakado et al. ..... 123/490

(Continued)

FOREIGN PATENT DOCUMENTS

JP 58-214081 12/1983
JP 62-070644 4/1987

(Continued)

OTHER PUBLICATIONS

International Search Report, PCT/JP2011/068054, dated Nov. 8, 2011, 5 pages.

*Primary Examiner* — Joseph Dallo
(74) *Attorney, Agent, or Firm* — Foley & Lardner LLP

(57) ABSTRACT

In a drive unit of a fuel injection device, an electric current is supplied to the fuel injection device by applying a high voltage to the fuel injection device from a high voltage source whose voltage is boosted to a voltage higher than a battery voltage at the time of opening a valve of the fuel injection device. Thereafter, the electric current supplied to the fuel injection device is lowered to a current value at which a valve element cannot be held in a valve open state by stopping the applying of the high voltage from the high voltage source. Thereafter, in a stage where a supply current is switched to a hold current, another high voltage is applied to the fuel injection device from the high voltage source.

18 Claims, 7 Drawing Sheets

(58) Field of Classification Search
CPC ..... F02D 2041/2013; F02D 2041/2003; F02D 41/30; F02D 41/345; F02D 2041/2037; F02M 69/04; F02M 51/061
USPC ..... 123/478, 480, 482, 490; 361/152, 154, 361/159, 160, 187, 194, 206–210
See application file for complete search history.

(56) References Cited

U.S. PATENT DOCUMENTS

| | | | | |
|---|---|---|---|---|
| 6,123,058 | A * | 9/2000 | Endou | 123/490 |
| 6,634,338 | B1 * | 10/2003 | Yamakado et al. | 123/490 |
| 6,657,846 | B1 * | 12/2003 | Philipp et al. | 361/160 |
| 6,892,708 | B2 * | 5/2005 | Nasu | 123/490 |
| 7,013,876 | B1 * | 3/2006 | Puckett et al. | 123/490 |
| 7,245,474 | B2 * | 7/2007 | Bolz et al. | 361/154 |
| 7,578,284 | B2 * | 8/2009 | Mayuzumi et al. | 123/490 |
| 7,621,259 | B2 * | 11/2009 | Mayuzumi | 123/490 |
| 7,789,073 | B2 | 9/2010 | Miyake et al. | |
| 2003/0010325 | A1 * | 1/2003 | Reischl et al. | 123/490 |
| 2003/0188717 | A1 * | 10/2003 | Aubourg | 123/490 |
| 2008/0276907 | A1 | 11/2008 | Abe et al. | |
| 2009/0177369 | A1 * | 7/2009 | Miyake et al. | 701/105 |
| 2009/0217914 | A1 * | 9/2009 | Casasso | 123/490 |

FOREIGN PATENT DOCUMENTS

| | | | |
|---|---|---|---|
| JP | 11-141722 | | 5/1999 |
| JP | 11-243013 | A | 9/1999 |
| JP | 2001-221121 | A | 8/2001 |
| JP | 2008-280876 | A | 11/2008 |
| JP | 2009-162115 | A | 7/2009 |
| JP | 2010-084552 | | 4/2010 |

* cited by examiner

PRIOR ART

DRIVE UNIT OF FUEL INJECTION DEVICE

TECHNICAL FIELD

The present invention relates to a drive unit of a fuel injection device which is used in an internal combustion engine, for example.

BACKGROUND ART

Recently, there has been a demand for the enhancement of fuel economy (fuel consumption ratio) in an internal combustion engine in view of tightening of regulations on the emission of carbonic acid gas or from the fear of the depletion of fossil fuels. To satisfy such a demand, efforts have been made to enhance fuel economy by reducing various losses in the internal combustion engine. In general, the reduction of losses can decrease an output necessary for an operation of the internal combustion engine and hence, a minimum output of the internal combustion engine can be made small. In such an internal combustion engine, it is necessary to supply fuel by controlling a fuel quantity such that even a small fuel quantity corresponding to the minimum output can be controlled.

Further, recently, a downsizing engine which acquires a required output with the use of a supercharger while miniaturizing a size thereof by reducing a displacement of an engine has been attracting attentions. In the downsizing engine, by making the displacement small, a pumping loss and a friction can be reduced so that fuel economy can be enhanced. On the other hand, while acquiring a sufficient output with the use of the supercharger, owing to an intake air cooling effect brought about by a cylinder direct injection, it is possible to prevent a compression ratio of the downsizing engine from being set low due to supercharging and hence, fuel economy can be enhanced. Particularly, in a fuel injection device used in such a downsizing engine, it is necessary to inject fuel over a wide range from a minimum injection quantity corresponding to a minimum output obtained by making the displacement small to a maximum injection quantity corresponding to a maximum output obtained by supercharging.

In general, an injection quantity of the fuel injection device is controlled based on a pulse width of an injection pulse (drive pulse) outputted from an ECU (Engine Control Unit). The longer the pulse width, the larger the injection quantity becomes, while the shorter the pulse width, the smaller the injection quantity becomes. The approximately linear relationship is established between the pulse width and the injection quantity. However, in a region where the injection pulse width is short, the injection quantity is not changed linearly with respect to the injection pulse width due to a rebound phenomenon which occurs when a movable element impinges on a stopper or the like (bound behavior of a movable element) thus giving rise to a drawback that a minimum injection quantity which the fuel injection device can control is increased. Further, there may be a case where the injection quantity does not become stable due to the above-mentioned rebound phenomenon of the movable element, and there has been a case where this unstable injection quantity causes the increase of the minimum injection quantity or causes the increase of individual irregularities among manufactured fuel injection devices.

As described above, to enhance fuel economy, it is necessary to reduce the minimum fuel quantity which the fuel injection device can control.

To reduce the minimum fuel quantity, it is necessary to suppress the bound behavior of the movable element. As a technique for satisfying such a request, in JP-A-58-214081, there is disclosed a solenoid valve drive unit where a speed of a plunger is decreased by rapidly cutting off an electric current immediately before a valve opening operation is completed (immediately before the plunger reaches a target lift amount) so that a rebound phenomenon of the plunger is suppressed whereby non-linearity of a flow rate characteristic is improved thus reducing a minimum injection quantity.

Further, as another means for reducing a minimum injection quantity, there has been known a fuel injection control device disclosed in JP-A-2009-162115. In such a fuel injection control device, an electric current is supplied to a fuel injection device from a high-voltage power source and, thereafter, the electric current is rapidly discharged so that the electric current is lowered to a first current value at which a valve element cannot be held in a valve open state or below and, thereafter, an electric current having a second current value at which the valve element can be held in the valve open state is supplied to the fuel injection device so that a delay in closing a fuel injection valve in a small pulse region can be decreased thus reducing a minimum injection quantity.

CITATION LIST

Patent Literature

PTL 1: JP-A-58-214081
PTL 2: JP-A-2009-162115

SUMMARY OF INVENTION

Technical Problem

In the above-mentioned prior art, timing at which a drive current is cut off is not necessarily sufficiently taken into account. In the course of the valve opening operation, a delay time exists before a magnetic attraction force is lowered after the drive current is cut off and hence, in addition to the cutting off of the drive current before the completion of opening of the valve, it is also necessary to cut off the drive current before desired deceleration timing.

Particularly, in a cylinder-injection-type fuel injection device which is required to exhibit high responsiveness, the movement of a valve element takes place at a high speed so that even when an electric current is cut off immediately before the completion of a valve opening operation of the valve element, opening of the valve is completed within a delay time before a magnetic attraction force is reduced and a deceleration force is obtained after the electric current is cut off so that a sufficient minimum injection quantity reducing effect cannot be acquired.

Further, in the device disclosed in JP-A-2009-162115, a drawback which arises when an electric current from a high-voltage power source is cut off and thereafter the electric current is restored to a hold current value at which a valve element is held in a valve opening state is not sufficiently taken into account.

In a case where an electric current is supplied from a high-voltage power source and, thereafter, the electric current is cut off so that the electric current is lowered to a current value at which a valve opening state cannot be held, the valve opening state cannot be maintained so that the valve is closed unless any measure is taken. Accordingly, it is necessary to supply an electric current of a current value which can maintain the valve opening state, that is, a hold current after the cutting off of the electric current. However, when the transition from the electric current of the current value during a cut-off period to the holding current is carried out using a battery voltage, a time necessary for the current value to reach a predetermined hold current is prolonged thus giving rise to a drawback that the valve opening state cannot be maintained in a stable manner.

It is an object of the present invention to provide a drive unit of a fuel injection device which can reduce a minimum injection quantity while suppressing the unstable behavior of a valve element.

Solution to Problem

A drive unit of a fuel injection device according to the present invention includes: a first voltage source; a second voltage source which supplies a voltage higher than a voltage of the first voltage source; and a voltage control means which selectively controls the electrical connection with the fuel injection device, wherein the voltage control means, at the time of opening a valve where the valve control means makes the fuel injection device operate a valve element from a valve closed state to a valve open state, applies the voltage of the second voltage source to the fuel injection device thus supplying a drive current for the valve element to the fuel injection device from the second voltage source and, thereafter, stops the applying of the voltage of the second voltage source and, then, applies the voltage of the first voltage source to the fuel injection device thus supplying a hold current for holding the valve element in the valve open state to the fuel injection device from the first voltage source, and when the voltage control means stops the applying of the voltage of the second voltage source, the voltage control means decreases the drive current for the valve element to a current value at which the valve element cannot be held in the valve open state by stopping the applying of the voltage of the second voltage source and, thereafter, restarts the applying of the voltage of the second voltage source so as to increase the drive current to a first target current value larger than the hold current and, thereafter, the drive current is lowered to a second target current value smaller than the first target current value and the hold current is supplied to the fuel injection device from the first voltage source.

Here, the drive current may be increased to the first target current value by applying the voltage of the second voltage source to the fuel injection device. Then, in decreasing the drive current for the valve element to the first target current value by stopping the applying of the voltage of the second voltage source, the applying of the voltage of the second voltage source may be stopped at timing where a moving speed of the valve element is decelerated before the valve element reaches a maximum lift position.

Further, after the drive current is increased to the first target current value larger than the hold current, a control may be performed so as to maintain the first target current value for a predetermined time and, thereafter, the drive current may be decreased to the second target current value. Here, the control for maintaining the first target current value for the predetermined time may be performed by applying the voltage of the first voltage source to the fuel injection device. Further, a control may be performed so as to maintain the second target current value for a predetermined time.

Further, as the power source which is used for increasing the drive current to the first target current value at which the valve element can be held in the valve open state from the current value at which the valve element cannot be held in the valve open state after decreasing the drive current for the valve element to the current value at which the valve element cannot be held in the valve open state by stopping the applying of the voltage of the second voltage source, either one of the first voltage source or the second voltage source may be selected.

Advantageous Effects of Invention

According to the present invention, the current value can be rapidly switched to the hold current value and hence, the unstable behavior of the valve element can be suppressed thus providing a drive unit of a fuel injection device which can reduce a minimum injection quantity.

Other objects, technical features and advantageous effects of the present invention will become apparent from the description of embodiments of the present invention explained hereinafter in conjunction with attached drawings.

A longitudinal cross-sectional view of a fuel injection device according to one embodiment of the present invention, and a view showing the constitution of a drive circuit which is connected to the fuel injection device and an engine control unit (ECU).

FIG. 2

A graph showing the relationship among a general injection pulse which drives the fuel injection device, timing at which a voltage and an excitation current are supplied to the fuel injection device, and the behavior of a valve element.

FIG. 3

Figure 2:
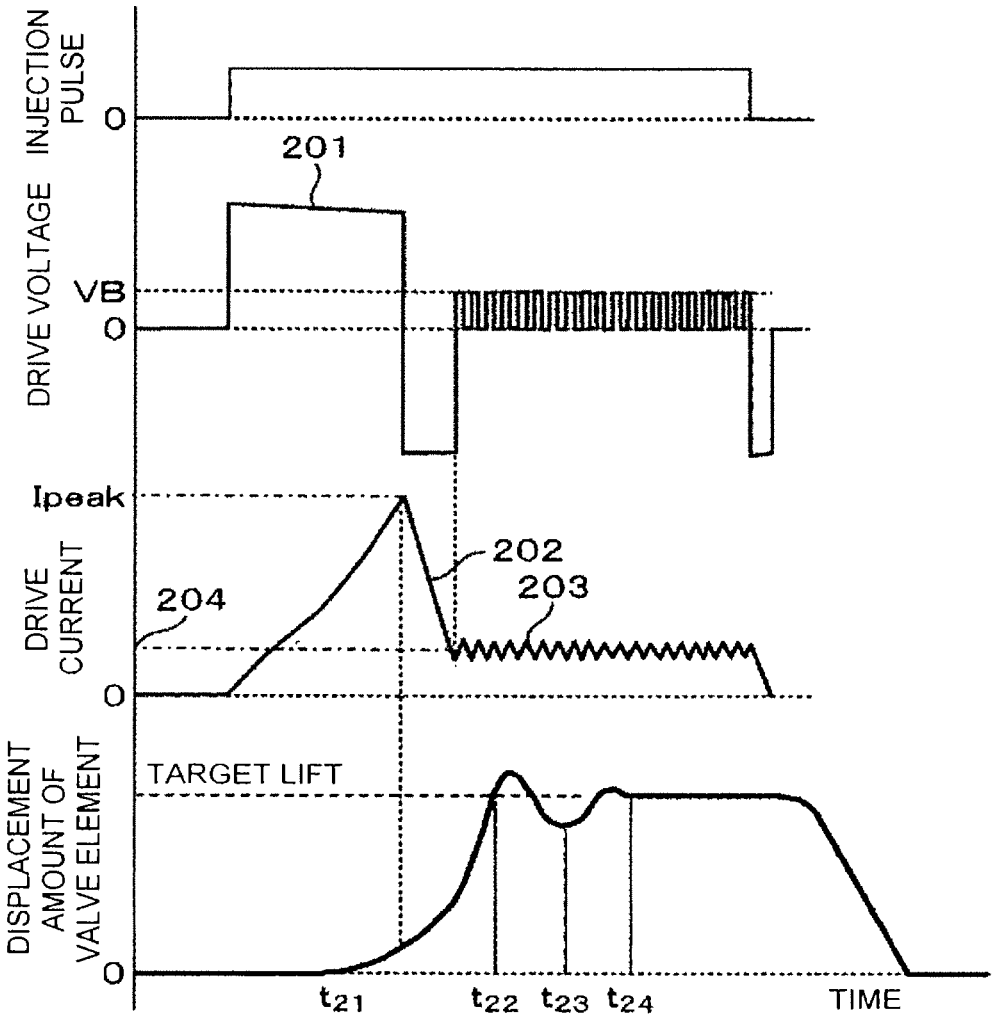

A graph showing the relationship between a pulse width Ti of the injection pulse in FIG. 2 and a fuel injection quantity.

FIG. 4

A graph showing the relationship among an injection pulse, a drive voltage and a drive current (excitation current) which are supplied to a fuel injection device, and a displacement amount of a valve element (behavior of the valve element) according to a first embodiment of the present invention.

FIG. 5

A graph showing the relationship between a pulse width Ti of the injection pulse and a fuel injection quantity according to the first embodiment.

FIG. 6

A graph showing the relationship among an injection pulse, a drive voltage and a drive current (excitation current) which are supplied to a fuel injection device, and a displacement amount of a valve element (behavior of the valve element) according to a second embodiment of the present invention.

FIG. 7

A graph showing the relationship among an injection pulse, a drive voltage and a drive current (excitation current) which are supplied to a fuel injection device, and a displacement amount of a valve element (behavior of the valve element) according to a third embodiment of the present invention.

FIG. 8

A constitutional view showing one embodiment of the present invention with respect to a drive circuit for driving the fuel injection device.

FIG. 9

Figure 8:
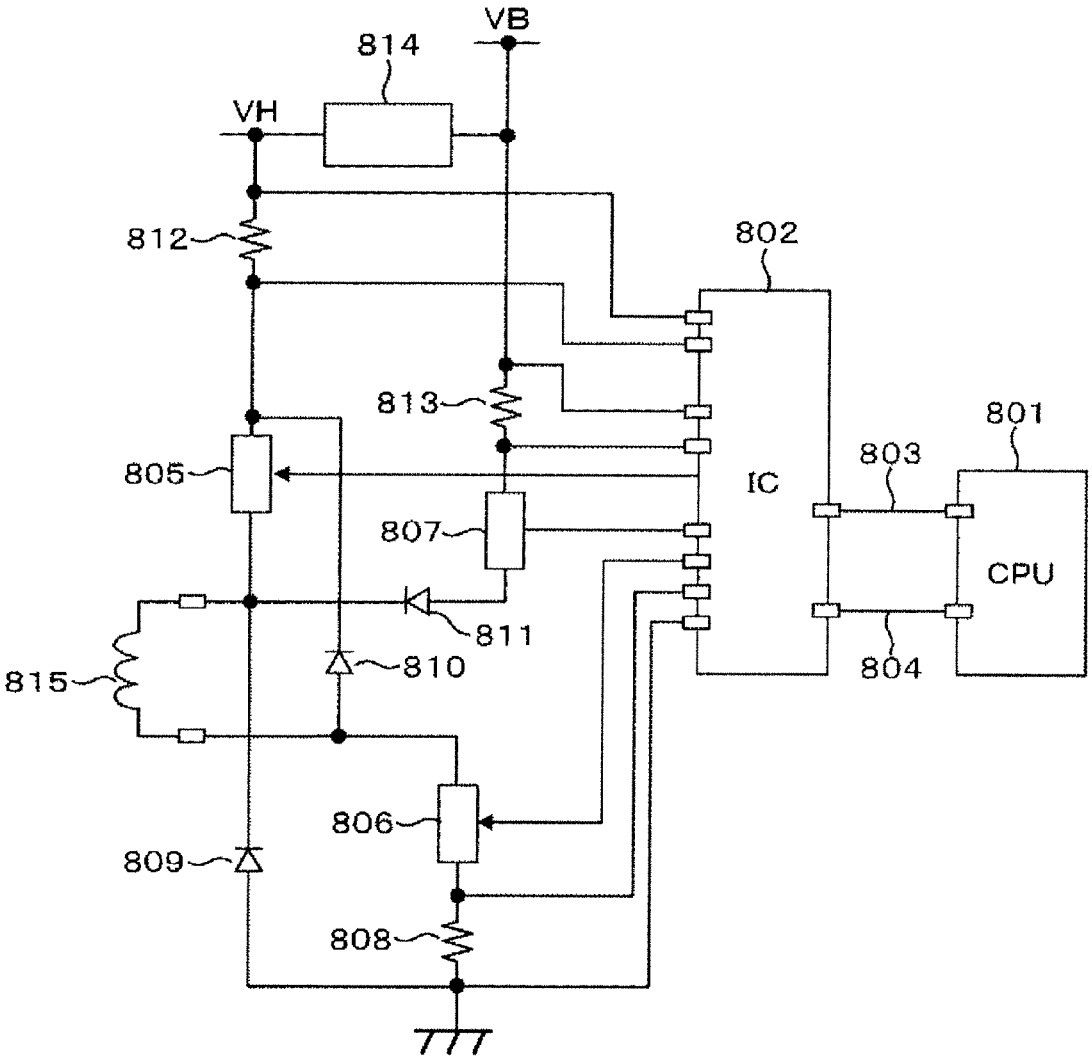

A graph showing an injection pulse, a drive current (excitation current), and switching timing of switching elements in the drive circuit shown in FIG. 8.

DESCRIPTION OF EMBODIMENTS

Hereinafter, the constitution and the manner of operation of a fuel injection device and a drive unit for driving the fuel injection device according to the present invention are explained in conjunction with FIG. 1 to FIG. 7.

Figure 1:
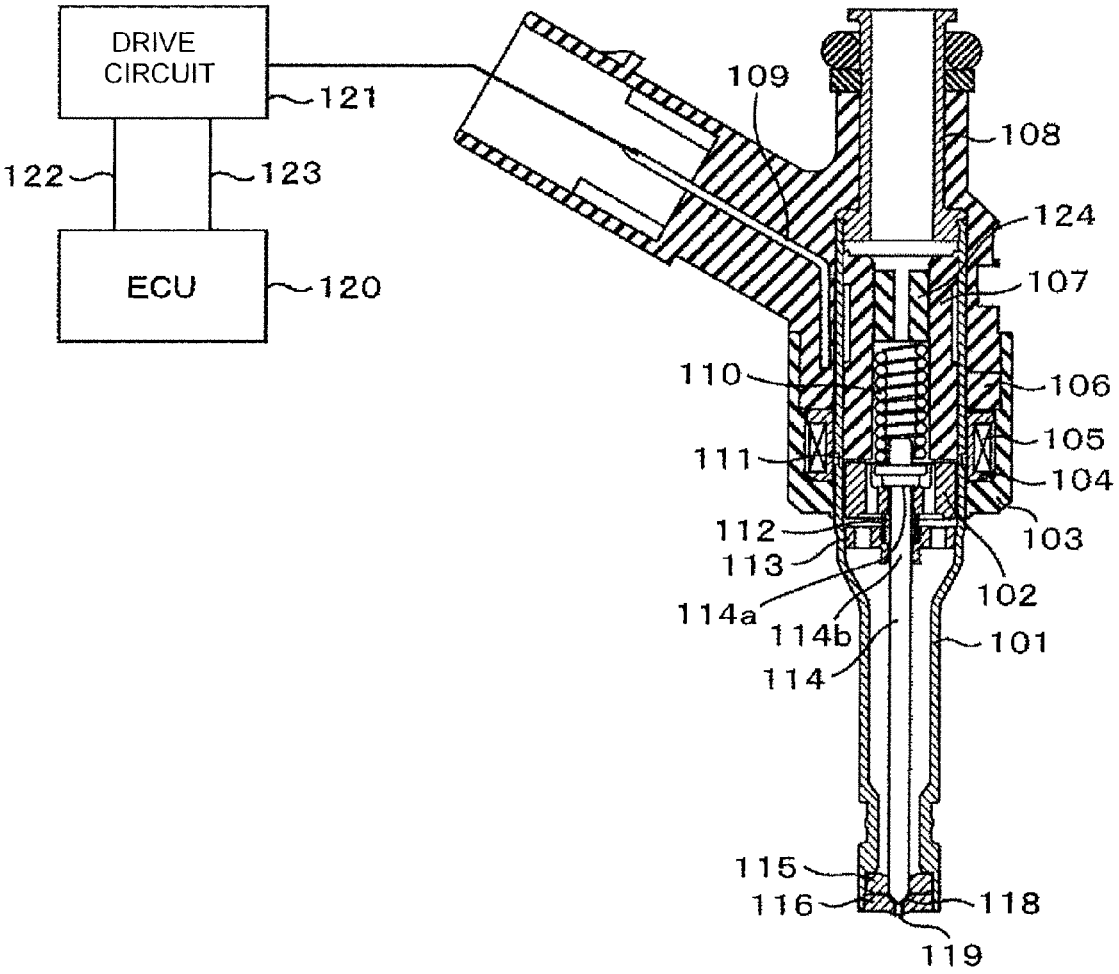
FIG. 1

Firstly, the constitution and the basic manner of operation of the fuel injection device and the drive unit for driving the fuel injection device are explained in conjunction with FIG. 1. FIG. 1 is a longitudinal cross-sectional view of the fuel injection device and a view showing one example of the constitution of an EDU (drive circuit: engine drive unit) 121 and an ECU (engine control unit) 120 for driving the fuel injection device. In this embodiment, although the ECU 120 and the EDU 121 are constituted as separate parts, the ECU 120 and the EDU 121 may be constituted as an integral part.

The ECU 120 fetches signals indicating a state of an engine from various sensors and calculates a proper width of an injection pulse and a proper injection timing corresponding to an operation condition of an internal combustion engine. The injection pulse outputted from the ECU 120 is inputted to the drive circuit 121 for the fuel injection device through a signal line 123. The drive circuit 121 controls a voltage applied to a solenoid 105, and supplies an electric current to the fuel injection device. The ECU 120 performs the communication with the drive circuit 121 through a communication line 122, and can switch a drive current generated by the drive circuit 121 corresponding to a pressure of fuel supplied to the fuel injection device and an operation condition of the internal combustion engine. The drive circuit 121 can change a control constant through the communication with the ECU 120, and a current waveform is changed corresponding to the control constant.

The constitution and the manner of operation of the fuel injection device are explained in conjunction with the longitudinal cross section of the fuel injection device.

The fuel injection device shown in FIG. 1 is a normally-closed solenoid valve (electromagnetic fuel injection valve). In a state where the solenoid (coil) 105 is not energized, a valve element 114 which constitutes a movable element is biased toward a valve seat 118 by a spring 110 which constitutes a first spring and is brought into close contact with the valve seat 118 whereby the fuel injection device assumes a closed state. In such a closed state, an anchor 102 is biased toward a fixed core 107 side (in the valve opening direction) by a zero position spring 112 which constitutes a second spring, and is brought into close contact with a restricting part 114*a* which is formed on a fixed-core-side end portion of the valve element 114. In this state, a gap is formed between the anchor 102 and the fixed core 107. A rod guide 113 which guides a rod portion 114*b* of the valve element 114 is fixed to a nozzle holder 101 which constitutes a housing. The valve element 114 and the anchor 102 are constituted in a relatively displaceable manner, and are embraced by the nozzle holder 101. Further, the rod guide 113 constitutes a spring seat for the zero position spring 112. A force generated by the spring 110 is adjusted by a pushing amount of a spring pusher 124 which is fixed to an inner periphery of the fixed core 107 at the time of assembling the fuel injection device. Here, a biasing force of the zero position spring 112 is set smaller than a biasing force of the spring 110.

In the fuel injection device, a magnetic circuit is constituted of the fixed core 107, the anchor 102 and a yoke 103, and an air gap is formed between the anchor 102 and the fixed core 107. A magnetic throttle 111 is formed in a portion of the nozzle holder 101 corresponding to an air gap formed between the anchor 102 and a fixed core 106. The solenoid 105 is mounted on an outer peripheral side of the nozzle holder 101 in a state where the solenoid 105 is wound around a bobbin 104.

A rod guide 115 is fixedly mounted on the nozzle holder 101 in the vicinity of an end portion of the valve element 114 on a side opposite to the restricting portion 114*a*. The movement of the valve element 114 in the valve shaft direction is guided by two rod guides, that is, the first rod guide 113 and the second rod guide 115.

An orifice plate 116 on which the valve seat 118 and a fuel injection hole 119 are formed is fixed to a distal end portion of the nozzle holder 101, and the orifice plate 116 seals an internal space (fuel passage) in which the anchor 102 and the valve element 114 are arranged from the outside.

Fuel is supplied from an upper portion of the fuel injection device, and fuel is sealed by a sealing portion which is formed on an end portion of the valve element 114 on a side opposite to the restricting portion 114*a* and the valve seat 118. At the time of closing the valve, the valve element is pushed in the valve closing direction by a pressure with a force corresponding to a seat inner diameter at a valve seat position due to a fuel pressure.

When the solenoid 105 is energized by an electric current, a magnetic flux is generated between the anchor 102 and the fixed core 107 thus generating a magnetic attraction force. When the magnetic attraction force which is applied to the anchor 102 exceeds the sum of a load generated by the spring 110 and a force generated by the fuel pressure, the anchor 102 is moved upwardly. Here, the anchor 102 is moved upwardly together with the valve element 114 in a state where the anchor 102 is engaged with the restricting portion 114*a* of the valve element 114, and the anchor 102 is moved until an upper end surface of the anchor 102 impinges on a lower surface of the fixed core 107.

As a result, the valve element 114 is moved away from the valve seat, and the supplied fuel is injected into the inside of the internal combustion engine from a plurality of fuel injection holes 119.

When the energization to the solenoid 105 is cut off, the magnetic flux generated in the magnetic circuit disappears and the magnetic attraction force also disappears. Since the magnetic attraction force acting on the anchor 102 disappears, the valve element 114 is pushed back to a closed position where the valve element 114 is brought into contact with the valve seat 118 due to the load generated by the spring 110 and the force generated by the fuel pressure. In an operation where the valve element 114 is pushed back to the closed position, the anchor 102 moves together with the valve element 114 in a state where the anchor 102 is engaged with the restricting portion 114*a* of the valve element 114.

In the fuel injection device of this embodiment, the relative displacement takes place between the valve element 114 and the anchor 102 in a very short time, that is, at the moment that the fixed core 107 and the anchor 102 impinge on each other at the time of opening the valve and at the moment that the valve element 114 impinges on the valve seat 118 at the time of closing the valve. Such relative displacement brings about an effect of suppressing the bouncing of the anchor 102 with respect to the fixed core 107 or the bouncing of the valve element 114 with respect to the valve seat 118.

Due to the above-mentioned constitution, the spring 110 biases the valve element 114 in the direction opposite to the direction of a drive force generated by the magnetic attraction force, and the zero position spring 112 biases the anchor 102 in the direction opposite to the direction of the biasing force of the spring 110.

Next, the relationship (FIG. 2) among a general injection pulse for driving the fuel injection device, a drive voltage, a drive current (excitation current), and a displacement amount of the valve element (behavior of the valve element) and the relationship (FIG. 3) between an injection pulse width and a fuel injection quantity are explained.

As shown in FIG. 2, when an injection pulse is inputted to the drive circuit 121 from the ECU 120, the drive circuit 121 applies a high voltage 201 to the solenoid 105 from a high voltage source whose voltage is boosted to a voltage higher than a battery voltage so that the supply of an electric current to the solenoid 105 is started. When a current value reaches a preset peak current value Ipeak, the drive circuit 121 stops the applying of the high voltage 201. Thereafter, the drive circuit 121 sets the voltage to be applied to a voltage of 0V or below thus lowering the current value as in the case of an electric current 202. When the current value becomes smaller than a predetermined current value 204, the drive circuit 121 performs the applying of the battery voltage by switching so as to control the drive current to a predetermined current 203.

The fuel injection device is driven in accordance with such a profile of the supply current. Lifting of the valve element is started during a period from a point of time at which the high voltage 201 is applied to the solenoid 105 to a point of time at which the electric current reaches a peak electric current, and the valve element shortly reaches a target lift position. After the valve element reaches the target lift position, due to the impingement between the anchor 102 and the fixed core 107, the valve element 114 performs a bound action, and the valve element 114 shortly comes to still at a predetermined target lift position by a magnetic attraction force which a holding current generates whereby the fuel injection device is brought into a stable valve open state. Here, the valve element 114 is configured to be displaceable relative to the anchor 102 and hence, the valve element 114 is displaced beyond the target lift position.

Figure 3:
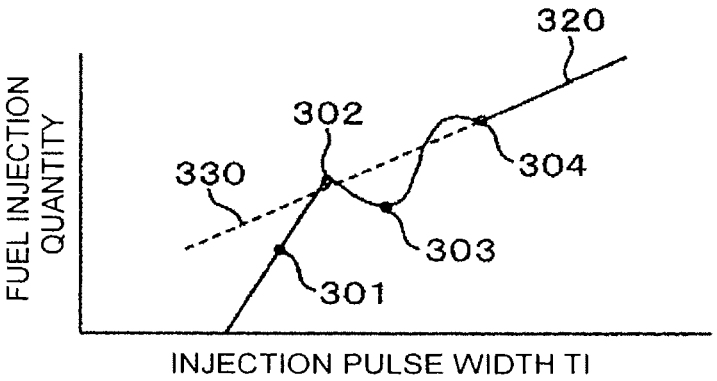
PRIOR ART FIG. 3

Next, the relationship between an injection pulse width Ti and a fuel injection quantity shown in FIG. 3 is explained. When the injection pulse width is not attained within a fixed time, the valve element is not opened and hence, fuel is not injected. Under a condition indicated by 301, for example, where the injection pulse width is short, although the valve element starts lifting, a valve closing operation starts before the valve element reaches the target lift position and hence, an injection quantity is decreased with respect to a broken line 330 extrapolated from a linear region 320. With the pulse width indicated by a point 302, the valve element starts the valve closing operation immediately after the valve element reaches the target lift position, and a rate of time necessary for closing of the valve is increased and hence, the injection quantity is increased with respect to the broken line 330. With the injection pulse width indicated by a point 303, the valve closing operation starts at a timing $t_{23}$ where a bound amount of the valve element becomes maximum and hence, a closing delay time from the cutting off of the injection pulse to the completion of the closing of the valve becomes small so that the injection quantity is decreased with respect to the broken line 330. A point 304 indicates a state where the closing of the valve starts at a timing $t_{24}$ immediately after the bound of the valve element is converged. With the injection pulse width larger than the point 304, the injection quantity of fuel is increased linearly corresponding to the increase of the injection pulse width Ti. After the injection of fuel starts, in a region extending to the pulse width indicated by the point 304, the bound of the valve element is not stable and hence, the injection quantity fluctuates. The increase of a region where the injection quantity of fuel is linearly increased corresponding to the increase of the fuel pulse width Ti is important for reducing a minimum injection quantity. In the general drive current waveform explained in conjunction with FIG. 2, the bound of the valve element 114 generated by the impingement between the anchor 102 and the fixed core 107 is large and hence, when the valve closing operation starts in the midst of bounding of the valve element 114, non-linearity is generated in the region having the short injection pulse width up to the point 304, and this non-linearity deteriorates the minimum injection quantity. Accordingly, to suppress the non-linearity of an injection quantity characteristic, it is necessary to reduce the bound of the valve element 114 which is generated after the valve element 114 reaches the target lift position.

Embodiment 1

Figure 4:
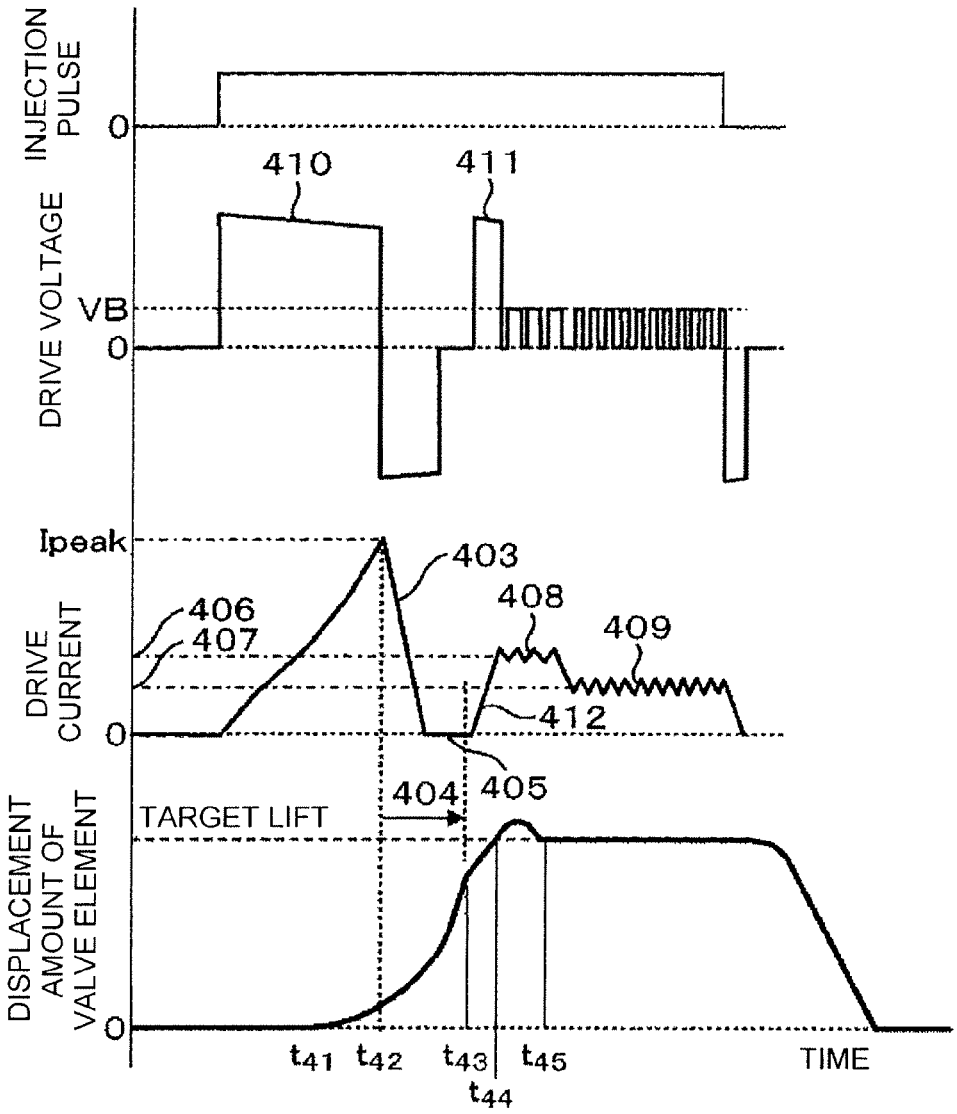
Figure 5:
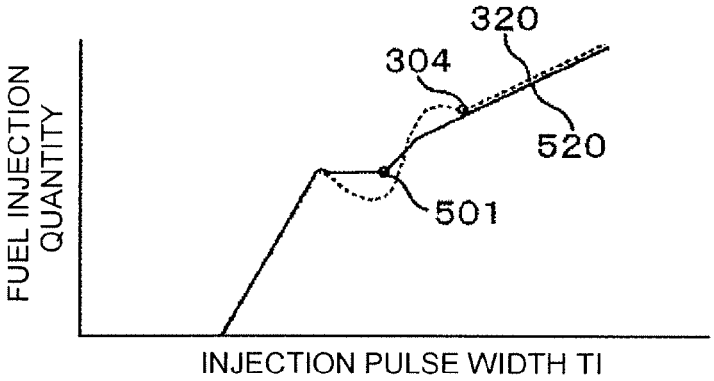

The first embodiment of the present invention is explained in conjunction with FIG. 4 and FIG. 5. FIG. 4 is a graph showing the relationship among an injection pulse outputted from an ECU (engine control unit), a drive voltage and a drive current (excitation current) which are supplied to a fuel injection device, and a displacement amount of a valve element (behavior of the valve element). FIG. 5 is a graph showing the relationship between a pulse width Ti of the injection pulse outputted from the ECU and a fuel injection quantity.

When an injection pulse is inputted to a drive circuit 121 from an ECU 120, a high voltage 410 is applied to a solenoid 105 from a high voltage source whose voltage is boosted to a voltage higher than a battery voltage so that the supply of an electric current to the solenoid 105 is started. When a current value reaches a preset peak current value Ipeak, the drive circuit 121 stops the applying of the high voltage and sets the voltage to be applied to a voltage of 0V or below thus lowering the current value as in the case of an electric current 403. Thereafter, the drive circuit 121 cuts off or suppresses the electric current value thus lowering the electric current to a current value at which a valve open state cannot be held as in the case of an electric current 405. The drive circuit 121 sets a drive current to an electric current smaller than a hold current value 409 for a predetermined time starting from cutting off of the electric current. Thereafter, the drive circuit 121 applies a high voltage 411 to the solenoid 105 from the high voltage source whose voltage is boosted to the voltage higher than the battery voltage again thus supplying the electric current to the solenoid 105. Due to such applying of the high voltage 411, the drive current is shifted to a hold current 408. In this manner, by lowering the electric current to a current value at which a valve open state can be maintained or below by cutting off the electric current and, thereafter, by applying a boosted high voltage, it is possible to rapidly shift the drive current to the current value at which the valve open state can be maintained in a stable manner.

Subsequently, when the electric current reaches a first current value 406 at which the valve open state can be held, the drive circuit performs the applying of the battery voltage by switching, and performs a control so as to maintain the first current value 406 and supplies the drive current 408 to the solenoid 105. After the drive current 408 is held for a predetermined time, the drive circuit lowers the current value. When the electric current reaches a second current value 407 at which the valve open state can be held, the drive circuit 121 performs the applying of the battery voltage by switching thus performing a control so as to maintain the second current value 407, and supplies the drive current 409 to the solenoid 105. By controlling the drive current 408 using the first current value 06 as a target current value, the switching from the drive current 408 to the drive current 409 and a valve closing operation can be rapidly performed. In this manner, the second current value 407 is set to a value smaller than the first current value 406 so that the drive current 409 becomes smaller than the drive current 408. The switching from the drive current 408 to the drive current 409 may be performed in two ways. In one way, the current value is rapidly lowered by applying a voltage of 0V or below to the solenoid 105 and, in the other way, the current value is gently changed by applying 0V or a positive voltage to the solenoid 105. A valve closing delay time starting from the cutting off of the injection pulse to the closing of the valve by the valve element is influenced by magnitude of the electric current value when the injection pulse is cut off. When this current value is small, the valve closing delay time becomes short. Accordingly, when the switching from the drive current 408 to the drive current 409 is rapidly performed using the voltage of 0V or below, it is possible to acquire an advantageous effect that an injection quantity can be rapidly shifted to a region where the valve closing delay time becomes constant, that is, a region where an injection quantity is changed linearly. When the switching from the drive current 408 to the drive current 409 is performed gently, it is possible to acquire an advantageous effect that an injection quantity during a switching period is gradually shifted to a linear region. These two ways may be selected depending on a characteristic of the fuel injection device which is an object to be driven.

Advantageous effects acquired by driving a valve element 114 in accordance with such a profile of the electric current are explained hereinafter. Here, lifting of the valve element 114 is started during a period starting from a point of time that the high voltage 410 is applied to the solenoid valve 105 to a point of time that the electric current reaches the peak current value Ipeak. After lifting of the valve element 114 is started, the electric current value is cut off or suppressed as in the case of the electric current 403 so that the electric current is lowered to a current value smaller than the drive current 409 as in the case of the electric current 405. A period starting from a point of time that the electric current reaches the peak current value Ipeak to a point of time that the electric current is lowered to the electric current value at which the valve open state cannot be held is referred to as a current lowing period. By providing such a current lowering period, the valve element 114 is decelerated at a timing $t_{43}$ immediately before an anchor 102 impinges on a fixed core 107 thus lowering a speed of the valve element 114 at the time of impingement whereby bound of the valve element after opening of the valve can be suppressed.

In such a current lowering period, a delay is generated between the cutting off of the drive current and lowering of a magnetic attraction force caused by the disappearing of a magnetic flux. Accordingly, a delay time 404 is generated between the cutting off of the electric current and the deceleration of the valve element 114. Accordingly, to decelerate the valve element at the timing $t_{43}$ immediately before the valve element 114 reaches a target lift position, it is necessary to start the cutting off of the electric current at a timing $t_{32}$ which is earlier than the timing $t_{43}$, for example. This timing at which the cutting off of the electric current is started may preferably be between a timing $t_{41}$ at which lifting of the valve element 114 is started and the timing $t_{43}$ at which the valve element 114 decelerates. By cutting off the electric current at such timing, the valve element 114 can be decelerated before the valve element 114 reaches the target lift position. Due to such a deceleration effect, it is possible to suppress a bound operation of the valve element 114 which occurs after the valve element 114 reaches the target lift position. As a result, it is possible to make an injection quantity characteristic in a region where an injection pulse width is short approximate a straight line and hence, a minimum injection quantity can be reduced.

Further, with respect to timing at which the electric current is cut off, it is preferable that the electric current is cut off in a stage where the high voltage 410 is applied and after timing at which the electric current reaches the current value 407 at which the valve open state can be maintained or more, and the cut-off timing comes earlier than the deceleration of the valve element. By cutting off the electric current at such timing, the valve element 114 surely starts opening of the valve and acquires a necessary speed, and can be decelerated before the valve element 114 reaches the target lift position. Due to such a deceleration effect, a bound operation of the valve element 114 which occurs after the valve element 114 reaches the target lift position at the time of opening the valve can be suppressed so that it is possible to make an injection quantity characteristic when an injection pulse width is short approximate a straight line whereby a minimum injection quantity can be reduced.

To consider a case where the high voltage 411 is not used in switching the drive current from the electric current 405 to the electric current 408 which differs from the case of the present invention, when the current lowering period is provided after the electric current reaches the peak current value Ipeak and the electric current 405 at which the valve open state cannot be held is set, the drive current and the behavior of the valve element 114 are displaced from predetermined values due to factors such as a peak current, a hold current, the current lowering period, shift timing from the electric current 405 to the electric current 408, a fuel pressure, and individual irregularities of the fuel injection devices thus giving rise to a possibility that the behavior of the valve element 114 becomes unstable. For example, when the transitional behavior of the valve element 114 until the valve element 114 reaches the target lift position is changed with respect to a predetermined operation so that a time until the valve element 114 reaches the target lift position becomes earlier compared to the predetermined behavior of the valve element 114, there exists a possibility that the valve element 114 reaches the target lift position during a period where a magnetic attraction force is lowered by the electric current 405 for decelerating the valve element 114. In this case, the magnetic attraction force sufficient for maintaining the valve element 114 in the valve open state cannot be ensured after the valve element 114 reaches the target lift position so that there may be a case where the behavior of the valve element 114 becomes unstable.

Due to the reasons explained heretofore, it is necessary to rapidly switch the electric current 405 to the electric current 408 after the valve element 114 reaches the target lift position from a viewpoint of stability of the behavior of the valve element 114. Accordingly, in this embodiment, by applying the voltage 411 to the solenoid 105 from the high voltage source during a switching period 412 where the drive current is switched from the electric current 405 to the electric current 408, the magnetic attraction force is rapidly generated again thus rapidly switching the current value from the electric current 405 to the electric current 408. Due to such an operation, it is possible to suppress the unstable behavior of the valve element which is generated due to a reason that the magnetic attraction force which can maintain the valve open state cannot be ensured. A hold time of the electric current 408 may preferably be set such that the electric current 408 is held for a fixed time and, thereafter, the electric current 408 is switched to the electric current 409 after the bound of the valve element 114 becomes stable. The electric current value at which the valve open state can be held changes depending on a profile of a force such as a pressure of a fuel supplied to the fuel injection device, a set load of a spring 110 or a zero position spring 112 of the fuel injection device or the generated magnetic attraction force. For example, in a case where a fuel pressure is changed corresponding to a rotational speed or a load of an engine so that the behavior of the valve element 114 can be made stable even with an electric current at the current value of the hold current 409, a current control where the drive current is directly switched to the hold current 409 from the current value 405 which is equal to or lower than the hold current 409 may be performed. Due to such a control of the electric current, the valve closing delay time during a period where the drive current is the electric current 408 can be reduced so that a minimum injection quantity in a state where the valve element 114 starts closing of the valve can be further reduced. Further, the current value at which opening of the valve can be held changes depending on the fuel pressure and hence, with respect to the hold currents 408, 409, it may be possible to perform a current control where rewriting of control parameters in the drive circuit 121 is performed by the ECU 120 such that the electric current is made small when the fuel pressure is low and the electric current is made large when the fuel pressure is high. Due to such a current control, the hold current can be made small when the fuel pressure is particularly low and hence, the valve closing delay time is made small whereby the minimum injection quantity can be reduced coupled with a bound suppression effect.

By suppressing the bound of the valve element 114 which is generated after the valve element reaches the target lift position at the time of opening the valve by the above-mentioned method, the linearity of the injection quantity characteristic shown in FIG. 5 can be enhanced as indicated by an injection quantity characteristic 520. With an injection quantity characteristic 320 having a conventional drive waveform, there exists a drawback that the injection quantity cannot be reduced below a point 304 because of the bound of the valve element 114. However, the bound of the valve element 114 can be suppressed by this embodiment so that the injection quantity can be reduced to a point 501. Accordingly, a region where the injection quantity characteristic takes a linear form can be enlarged to a low flow rate side thus reducing the minimum injection quantity which can be controlled.

When the drive method according to the present invention is used, compared to the drive waveform explained in conjunction with FIG. 2, there may be a case where a limit of a fuel pressure at which the fuel injection device is operated normally is lowered. Accordingly, it is effective to perform switching of the drive current such that a drive current waveform according to this embodiment is used under a condition where the minimum injection quantity is necessary, and the drive current explained in conjunction with FIG. 2 is used when an operation at a high fuel pressure is necessary.

The constitution of the drive circuit of the fuel injection device according to the first embodiment is explained in conjunction with FIG. 8. FIG. 8 is a view showing the constitution of the circuit which drives the fuel injection device. A CPU 801 is incorporated into the ECU 120, for example. The CPU 801 calculates a proper pulse width of the injection pulse Ti (that is, injection quantity) and injection timing corresponding to an operation condition of the internal combustion engine, and outputs the injection pulse Ti to a drive IC 802 of the fuel injection device through a communication line 804. Thereafter, the drive IC 802 switches on or off switching elements 805, 806, 807 so that a drive current is supplied to a fuel injection device 815.

The switching element 805 is connected between a high voltage source VH whose voltage is higher than a voltage of a voltage source VB inputted to the drive circuit and a high-voltage-side terminal of the fuel injection device 807. The switching elements 805, 806, 807 are each constituted of an FET, a transistor or the like, for example. A voltage value of the high voltage source VH is 60V, for example, and is generated by boosting the battery voltage using a booster circuit 814. The booster circuit 814 is constituted of a DC/DC converter or the like, for example. The switching element 807 is connected between the low voltage source VB and the high voltage terminal of the fuel injection device. The low voltage source VB is the battery voltage, for example, and a voltage value of the low voltage source VB is 12V. The switching element 806 is connected between a low-voltage-side terminal of the fuel injection device 815 and a ground potential. The drive IC 802 detects a current value of an electric current which flows into the fuel injection device 815 using resistors 808, 812, 813 for electric current detection, and switches on or off the switching elements 805, 806, 807 in accordance with the detected current value thus generating a desired drive current. Diodes 809, 810 are provided for cutting off an electric current. The CPU 801 performs communication with the drive IC 802 through a communication line 803, and can switch a drive current generated by the drive IC 802 corresponding to a pressure of fuel supplied to the fuel injection device 815 and an operation condition.

Figure 9:
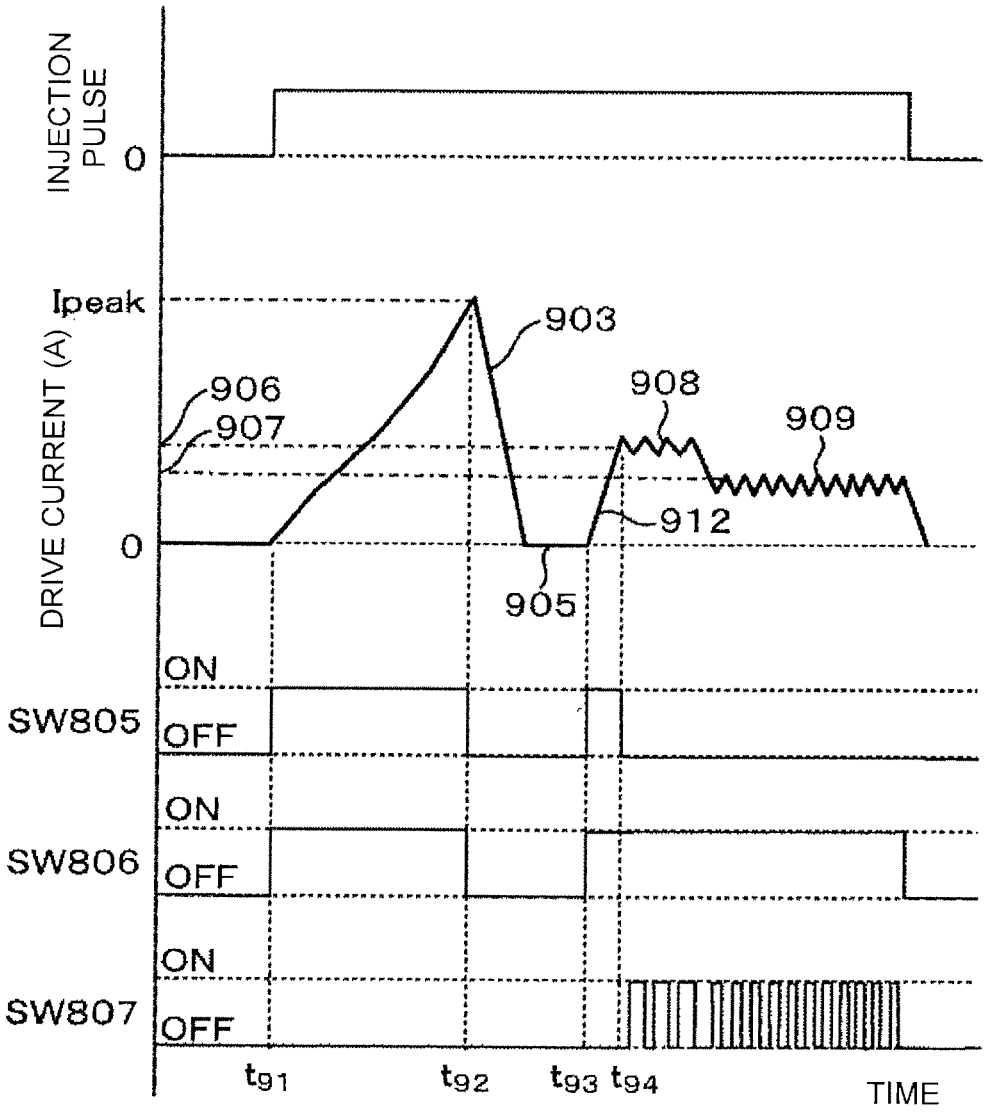

Switching timing of the switching elements for generating the excitation current which flows into the fuel injection device in the first embodiment is explained in conjunction with FIG. 8 and FIG. 9.

FIG. 9 is a view showing an injection pulse and a drive current (excitation current) outputted from the CPU 801, and ON/OFF timings of the switching element 805, the switching element 806 and the switching element 806.

When the injection pulse Ti is inputted to the drive IC 802 from the CPU 801 through the communication line 804 at a timing $t_{91}$, the switching element 805 and the switching element 806 are turned on so that a drive current is supplied to the fuel injection device 815 from the high voltage source VH whose voltage is higher than the battery voltage whereby the drive current rapidly rises. When the drive current reaches the peak current Ipeak, all of the switching element 805, the switching element 806 and the switching element are turned off. Accordingly, due to a reverse electromotive force generated by inductance of the fuel injection device 815, the diode 809 and the diode 810 are energized so that the drive current is fed back to a voltage power source VH side whereby the drive current supplied to the fuel injection device 815 is rapidly lowered from the peak current value Ipeak as in the case of an electric current 903. When the switching element 806 is turned on during a transitional period from the peak current value Ipeak to an electric current 905, the electric current generated by reverse electromotive force energy flows toward a ground potential side so that the electric current is gradually lowered. Thereafter, when a timing $t_{93}$ arrives, the switching element 805 and the switching element 806 are turned on again so that a drive current is supplied to the fuel injection device 815 from the high voltage source VH whereby the electric current rapidly rises. When the electric current reaches a current value 906 thereafter, the switching element 805 is turned off and an ON/OFF state of the switching element 807 is switched so that an electric current 908 is controlled so as to hold the electric current at the current value 906 or a current value close to the current value 906. After holding the electric current 908 for a fixed time, the switching element 807 is turned off so that the electric current is lowered. When the electric current reaches a current value 907, the ON/OFF state of the switching elements is switched again so that an electric current 909 is controlled so as to hold the electric current at the current value 907 or at a current value close to the current value 907. Thereafter, when the injection pulse assumes an OFF state, both the switching element 806 and the switching element 807 are turned off so that the electric current is lowered.

Embodiment 2

Figure 6:
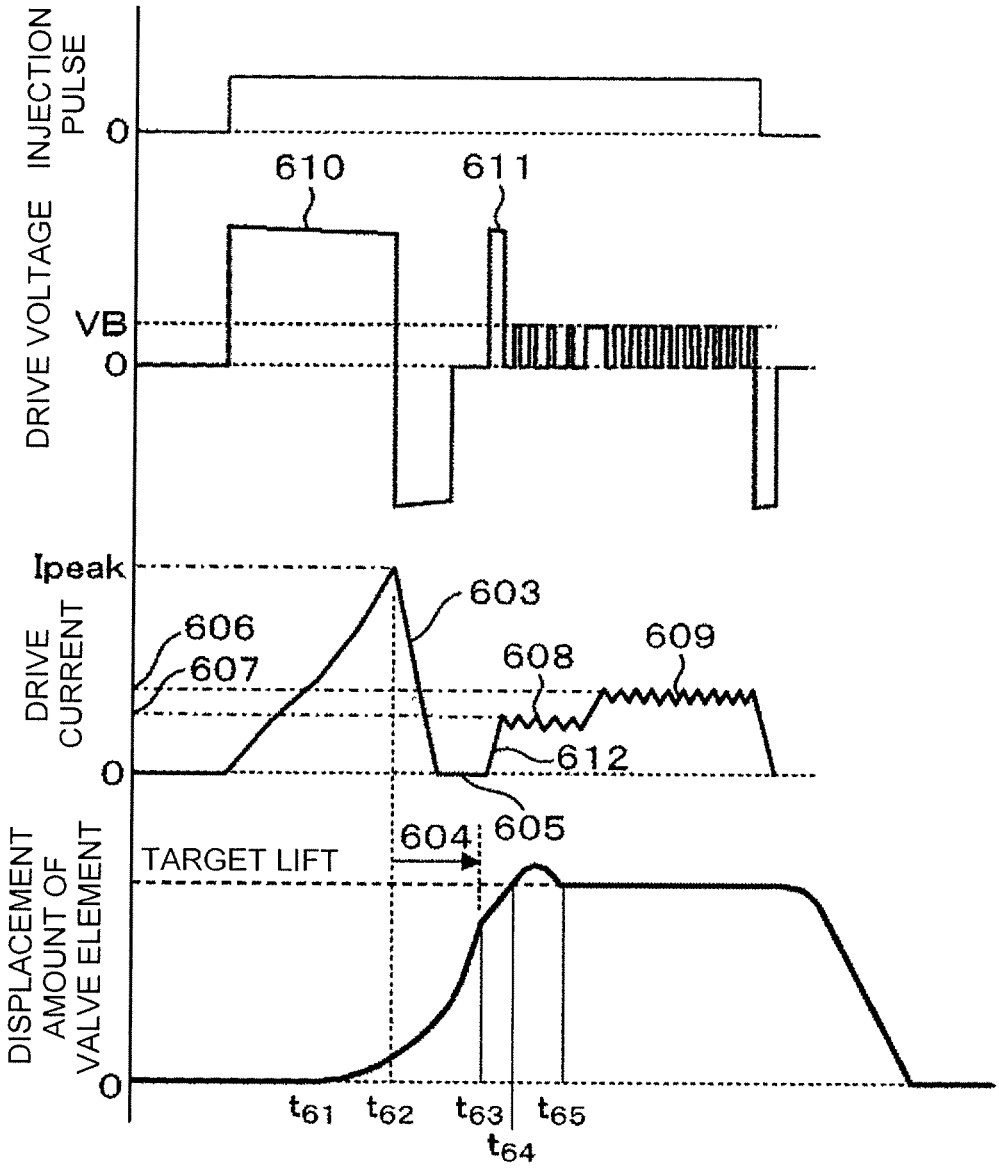

The second embodiment is explained in conjunction with FIG. 6. FIG. 6 is a graph showing the relationship among an injection pulse outputted from an ECU (engine control unit), a drive voltage and a drive current (excitation current) which are supplied to a fuel injection device, and a displacement amount of a valve element (behavior of the valve element). A control of the drive voltage or the drive current explained hereinafter can be carried out using the drive circuit shown in FIG. 8 which is explained in conjunction with the first embodiment by changing a control method (switching timing) of the drive voltage or the drive current.

When an injection pulse is inputted to the drive circuit, a high voltage 610 is applied to a solenoid 105 from a high voltage source VH whose voltage is boosted to a voltage higher than a battery voltage so that the supply of an electric current to the solenoid 105 is started. When a current value reaches a preset peak current value Ipeak, the drive circuit stops the applying of the high voltage and sets a voltage to be applied to a voltage of 0V or below thus lowering the current value as in the case of an electric current 603. Thereafter, the drive circuit cuts off the electric current thus lowering the electric current to a current value at which a valve open state cannot be held as in the case of an electric current 605. The drive circuit sets the drive current to an electric current smaller than a current value 607 at which a valve element 114 can be held for a predetermined time starting from the cutting off of the electric current. Thereafter, the drive circuit applies a high voltage 611 to the solenoid 105 from the high voltage source VH whose voltage is boosted to the voltage higher than the battery voltage again thus supplying an electric current to the solenoid 105. Due to such applying of the voltage 611, the drive current is shifted to a hold current 608. In this manner, by lowering the electric current to a current value below the current value at which the valve open state can be held by cutting off the electric current and, thereafter, by applying a boosted high voltage, it is possible to rapidly shift the drive current to a current value at which the valve open state can be maintained in a stable manner.

Subsequently, when the electric current reaches the first current value 607 at which the valve open state can be held, the drive circuit performs the applying of the battery voltage by switching thus performing a control so as to hold the current value at the current value 607 or at a current value close to the current value 607, and supplies the drive current 608 to the solenoid 105. After the drive current 608 is held for a predetermined time, the drive circuit increases the electric current. When the electric current reaches a second current value 606 at which the valve open state can be held, the drive circuit performs the applying of the battery voltage by switching thus performing a control so as to hold the current value at the current value 606 or at the current value close to the current value 606, and supplies a drive current 609 larger than the drive current 608 to the solenoid 105.

The switching from the drive current 608 to the drive current 609 may be performed in two ways. In one way, the current value is rapidly increased by applying the high voltage to the solenoid 105 from the high voltage source VH whose voltage is boosted to the voltage higher than the battery voltage and, in the other way, the current value is gently changed by applying the battery voltage to the solenoid 105. A valve closing delay time starting from the cutting off of the injection pulse to the closing of the valve by the valve element 114 is influenced by an electric current value when the injection pulse is cut off. When this current value is small, the valve closing delay time becomes short. Accordingly, when the switching from the drive current 608 to the drive current 609 is rapidly performed using the high voltage from the high voltage source VH whose voltage is boosted to the voltage higher than the battery voltage, it is possible to acquire an advantageous effect that an injection quantity can be rapidly shifted to a region where the injection quantity is changed linearly. When the switching from the drive current 608 to the drive current 609 is performed gently, it is possible to acquire an advantageous effect that an injection quantity during a switching period where the drive current is switched from the drive current 608 to the drive current 609 is gradually shifted to a linear region. These two ways may be selected depending on a characteristic of the fuel injection device which is an object to be driven.

Advantageous effects acquired by driving the valve element in accordance with such a profile of an electric current are explained hereinafter. Here, lifting of the valve element 114 is started during a period starting from a point of time that the applying of a high voltage 610 to the solenoid valve 105 is started to a point of time that an electric current reaches the peak current value Ipeak. After lifting of the valve element 114 is started, a current lowering period during which a current value is lowered is provided as in the case of the electric current 603. During such a period, as in the case of the electric current 605, the current value is lowered to a current value (a current value lower than the drive current 608 and the drive current 609) at which the valve open state cannot be held. By providing such a current lowering period, the valve element 114 is decelerated at a timing $t_{63}$ immediately before an anchor 102 impinges on a fixed core 107 thus lowering a speed of the valve element 114 at the time of impingement whereby bound of the valve element 114 after opening of the valve can be suppressed.

Here, a delay is generated between the cutting off of the drive current and lowering of a magnetic attraction force caused by the disappearing of a magnetic flux. Accordingly, a delay time 604 is generated between the cutting off of the electric current and the deceleration of the valve element 114. This timing at which the cutting off of the electric current is started may preferably be between a timing $t_{61}$ at which lifting of the valve element 114 is started and the timing $t_{63}$ at which the valve element 114 decelerates. The advantageous effect obtained by such timing is substantially equal to the advantageous effect acquired by the corresponding timing adopted in the first embodiment.

Further, with respect to the timing at which the electric current is cut off, it is preferable that the electric current is cut off in a stage where the high voltage 610 is applied and after timing at which the electric current reaches the current value 607 at which the valve open state can be maintained or more, and the cut off timing comes earlier than the deceleration of the valve element 114. By cutting off the electric current at such timing, the valve element 114 surely starts opening of the valve and acquires a necessary speed, and can be decelerated before the valve element 114 reaches the target lift position. Due to such a deceleration effect, a bound operation of the valve element 114 which occurs after the valve element 114 reaches the target lift position at the time of opening the valve can be suppressed so that a region where the injection quantity characteristic takes a linear form is enlarged to a low flow rate side thus reducing a minimum injection quantity.

By suppressing the bound of the valve element 114 which is generated after the valve element reaches the target lift position at the time of opening the valve by the above-mentioned method, the linearity of the injection quantity characteristic can be enhanced. Further, by setting the drive current 608 smaller than the drive current 609, the electric current 605 is gently shifted to the drive current 609 so that the injection quantity characteristic can be gently shifted to the liner region whereby the bound of the valve element 114 can be converged within a period where the drive current 608 is supplied, and a minimum injection quantity in a state where closing of the valve starts can be reduced.

Embodiment 3

Figure 7:
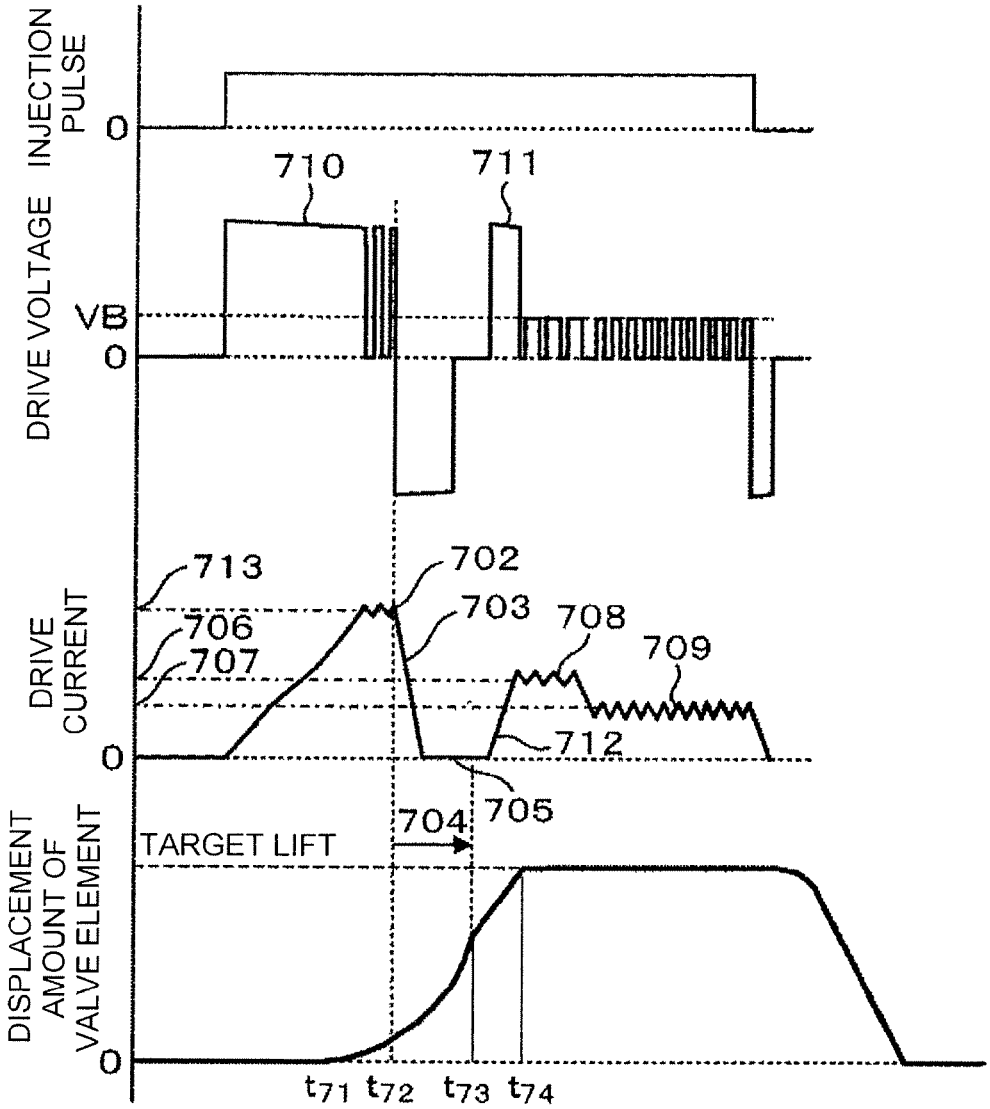

The third embodiment is explained in conjunction with FIG. 7. FIG. 7 is a graph showing the relationship among an injection pulse outputted from an ECU (engine control unit), a drive voltage and a drive current (excitation current) which are supplied to a fuel injection device, and a displacement amount of a valve element (behavior of the valve element). A control of the drive voltage or the drive current explained hereinafter is carried out using the drive circuit shown in FIG. 8 which is explained in conjunction with the first embodiment by changing a control method (switching timing) of the drive voltage or the drive current.

The point which makes this embodiment differ from the first embodiment lies in that when a current value reaches a preset current value 713, a drive circuit 121 performs a control such that a high voltage source VH is applied by switching so that a predetermined electric current 702 is held for a fixed time. Advantageous effects acquired by holding the electric current 702 for a fixed time are explained hereinafter.

Lifting of a valve element 114 is started during a period from a point of time that applying of a high voltage 710 is started to a point of time that an electric current reaches the peak current value 713. Thereafter, the current value is held for a fixed period as in the case of the electric current 702 which has the current value 713 smaller than a peak current Ipeak in the first embodiment and the second embodiment. Since the electric current 702 can be suppressed lower than the peak current Ipeak, it is possible to acquire an advantageous effect that the heat generation in the drive circuit 121 and the fuel injection device can be suppressed. On the other hand, by supplying the electric current 702 by switching the high voltage source VH, the electric current can be supplied for a time necessary for opening of the valve while suppressing the peak current. Switching of the high voltage source VH may be performed such that switching is performed between the high voltage source and a battery voltage. In this case, a width between a maximum value and a minimum value of an electric current which is generated by switching a high voltage with the electric current 702 can be made small and hence, it is possible to supply the electric current in a stable manner.

Further, by setting the current value at a timing $t_{72}$ where the electric current is cut off lower than the peak current value in the first embodiment and the second embodiment, shifting of an electric current from the electric current at timing at which the electric current is cut off to an electric current 705 at which a valve open state cannot be held can be accelerated. As a result, the valve element 114 can be decelerated at a timing $t_{73}$ before an anchor 102 impinges on a fixed core 107 so that a deceleration effect can be acquired at timing earlier than the deceleration timing in the first embodiment and the second embodiment. Accordingly, an impingement speed of the valve element 114 at a point of time $t_{74}$ where the valve element 114 reaches a target lift position is lowered thus enhancing a bound suppression effect after opening the valve.

In the third embodiment, an electric current is cut off after the electric current reaches the peak current value, and the electric current is rapidly lowered to the current value at which the valve open state cannot be maintained. Accordingly, compared to the drive waveform explained in conjunction with FIG. 2, a limit of a fuel pressure at which the fuel injection device is normally operated is lowered. Accordingly, it is effective to perform switching of a drive current such that the drive current in any one of the first embodiment, the second embodiment and the third embodiment of the present invention is used when a minimum injection quantity is required, and the drive current explained in conjunction with FIG. 2 is used when an output is required.

Further, according to the respective embodiments of the present invention, an impingement speed between the anchor 102 and the fixed core 107 at the time of opening of the valve can be decreased thus eventually lowering drive noises of the fuel injection device.

Further, in the respective embodiments of the present invention, the fuel injection device explained in conjunction with FIG. 1, that is, the fuel injection device where the anchor 102 and the valve element 114 are formed as separate parts may be used. However, the advantageous effects of the present invention can be effectively acquired even when a fuel injection device where the anchor 102 and the valve element 114 are formed as the integral structure is used.

Although the present invention has been described with respect to the embodiments, it is apparent to those who are skilled in the art that the present invention is not limited to such embodiments, and various changes and modifications can be made within the gist of the present invention and within the scope of the attached claims.

REFERENCE SIGNS LIST

101: nozzle holder
102: anchor

103: yoke
105: solenoid
107: fixed core
110: spring
112: zero position spring
113, 115: rod guide
114: valve element
116: orifice plate
118: valve seat
119: fuel injection

The invention claimed is:

1. A drive unit of a fuel injection device which has an anchor, a fixed core attracting the anchor by a magnetic attraction force, and a valve element formed separately from the anchor and driven by the anchor, comprising:

a drive circuit configured to apply a voltage larger than a battery voltage to the fuel injection device, thereby causing the valve element to open by the anchor which is attracted to the fixed core, then apply a voltage below 0V to the fuel injection device and reduce a drive current to a first current value at which the valve element cannot be held in a valve open state by the voltage below 0V before the anchor impinges on the fixed core and the valve element reaches a target lift amount, and then apply a voltage to the fuel injection device so that the drive current is increased to a second current value at which the valve element can be held in the valve open state.

2. The drive unit of the fuel injection device according to claim 1, wherein a booster circuit which boosts the battery voltage generates a voltage larger than the battery voltage.

3. The drive unit of the fuel injection device according to claim 2, wherein the booster circuit is provided in the drive unit.

4. The drive unit of the fuel injection device according to claim 1, wherein a voltage source of the battery voltage or a voltage source of a voltage larger than the battery voltage is selectable as a voltage source which applies a voltage to the fuel injection device in order to increase the drive current of the valve element to the second current value.

5. The drive unit of the fuel injection device according to claim 1, wherein a timing at which the voltage below 0V is applied to the fuel injection device is between a timing at which the valve element starts opening of the valve and a timing at which the valve element is decelerated.

6. A fuel injection system, comprising:

the fuel injection device and the drive unit according to claim 1.

7. The fuel injection system according to claim 6, wherein a timing at which the drive current that has been lowered to the first current value or below is supplied to a solenoid is between a timing at which the valve element starts opening of the valve and a timing at which the valve element is decelerated.

8. A drive unit of an electromagnetic valve device including an anchor, a valve element formed separately from the anchor and driven by the anchor, a fixed core attracting the anchor by a magnetic attraction force, and a solenoid, the drive unit comprising a drive circuit configured to apply a voltage to the solenoid and generate the magnetic attraction force between the anchor and the fixed core, apply a voltage to the solenoid thereby causing the valve element to open by the anchor which is attracted to the fixed core, and then apply a voltage below 0V to the solenoid and reduce a drive current to a first current value at which the valve element cannot be held in a valve open state by the voltage below 0V before the anchor impinges on the fixed core and the valve element reaches a target lift amount.

9. The drive unit of the electromagnetic valve device according to claim 8, wherein the drive circuit applies the voltage below 0V to the solenoid, and the drive current flowing through the solenoid is lowered to the first current value at which the valve cannot be held in the valve open state, and, thereafter, the drive circuit applies a voltage larger than 0V to the solenoid.

10. The drive unit of the electromagnetic valve device according to claim 8, wherein a time for applying the voltage to the solenoid in order to open the valve element is longer than a time for applying the voltage below 0V to the solenoid.

11. The drive unit of the electromagnetic valve device according to claim 8, wherein, by applying the voltage below 0V to the solenoid, a drive current supplied to the solenoid is lowered to the current value at which the valve element cannot be held in the valve open state or below.

12. The drive unit of the electromagnetic valve device according to claim 8, wherein the drive unit is configured to:

apply the voltage below 0V to the solenoid, cut off the drive current supplied to the solenoid, and then apply a voltage larger than 0V to the solenoid.

13. The drive unit of the electromagnetic valve device according to claim 10, wherein a period of time for applying a high voltage exceeds a period of time for applying a reverse voltage.

14. The drive unit of the electromagnetic valve device according to claim 10, wherein the drive circuit is configured to stop application of high voltage to thereby reduce the current at which the valve open state cannot be held.

15. The drive unit of the electromagnetic valve device according to claim 10, wherein the drive circuit is configured to apply a reverse voltage to the electromagnetic valve device before cutting off current.

16. The drive unit of the fuel injection device according to claim 1, wherein the drive circuit is configured to select between a first voltage source and a second voltage source to increase the drive current after reducing the drive current to the first current value.

17. The drive unit of the electromagnetic valve device according to claim 8, wherein the drive circuit is configured to select between a first voltage source and a second voltage source to increase the drive current after reducing the drive current to the first current value.

18. A drive unit of a fuel injection device, comprising:

a drive circuit which is configured to open and close a valve element of the fuel injection device by applying a voltage to the fuel injection device, wherein the drive circuit is configured to open the valve element of the fuel injection device by applying a voltage larger than a battery voltage to the fuel injection device, applying a voltage below 0V to the fuel injection device and reducing a drive current to a first current value at which the valve element cannot be held in a valve open state by the voltage below 0V before the valve element reaches a target lift amount, and then applying a voltage to the fuel injection device so that the drive current of the valve element is increased to a second current value at which the valve element can be held in the valve open state, wherein the drive circuit is configured to select between a first voltage source and a second voltage source to increase the drive current after reducing the drive current to the first current value.

* * * * *